US009290835B2

(12) United States Patent
Yoshinaga et al.

(10) Patent No.: US 9,290,835 B2
(45) Date of Patent: Mar. 22, 2016

(54) COLD-ROLLED STEEL SHEET EXCELLENT IN PAINT BAKE HARDENABILITY AND ORDINARY-TEMPERATURE NON-AGING PROPERTY AND METHOD OF PRODUCING THE SAME

(75) Inventors: Naoki Yoshinaga, Kimitsu (JP); Naoki Maruyama, Futtsu (JP); Manabu Takahashi, Futtsu (JP); Natsuko Sugiura, Futtsu (JP)

(73) Assignee: Nippon Steel & Summitomo Metal Corporation, Tokyo (JP)

( * ) Notice: Subject to any disclaimer, the term of this patent is extended or adjusted under 35 U.S.C. 154(b) by 0 days.

(21) Appl. No.: 11/992,685

(22) PCT Filed: Oct. 5, 2005

(86) PCT No.: PCT/JP2005/018726
§ 371 (c)(1),
(2), (4) Date: Mar. 26, 2008

(87) PCT Pub. No.: WO2007/043168
PCT Pub. Date: Apr. 19, 2007

(65) Prior Publication Data

US 2009/0255610 A1 Oct. 15, 2009

(51) Int. Cl.

| | |
|---|---|
| ***C21D 8/02*** | (2006.01) |
| ***C23C 2/06*** | (2006.01) |
| ***C21D 9/46*** | (2006.01) |
| ***C22C 38/00*** | (2006.01) |
| ***C22C 38/32*** | (2006.01) |
| ***C23C 2/28*** | (2006.01) |
| *C22C 38/18* | (2006.01) |
| *B21B 3/02* | (2006.01) |

(52) U.S. Cl.
CPC ... *C23C 2/06* (2013.01); *C21D 8/02* (2013.01); *C21D 9/46* (2013.01); *C22C 38/001* (2013.01); *C22C 38/002* (2013.01); *C22C 38/32* (2013.01); *C23C 2/28* (2013.01); *B21B 3/02* (2013.01)

(58) Field of Classification Search
CPC ..... C21D 8/02; C21D 9/46; C22C 38/001; C22C 38/002; C23C 2/06; C23C 2/28; B21B 3/02
USPC ..... 148/537, 320; 428/659
See application file for complete search history.

(56) References Cited

U.S. PATENT DOCUMENTS

| | | | | |
|---|---|---|---|---|
| 6,143,100 | A * | 11/2000 | Sun | 148/533 |
| 6,544,354 | B1 * | 4/2003 | Kawano et al. | 148/320 |
| 2002/0197508 | A1 | 12/2002 | Yoshinaga et al. | |

FOREIGN PATENT DOCUMENTS

| | | | | |
|---|---|---|---|---|
| JP | 59-031827 | | 2/1984 | |
| JP | 60-174852 | | 9/1985 | |
| JP | 06179922 | A * | 6/1994 | C21D 9/48 |
| JP | 7-278770 | A | 10/1995 | |
| JP | 07-300623 | | 11/1995 | |
| JP | 10-008143 | | 1/1998 | |
| JP | 2002-69533 | A | 3/2002 | |
| JP | 2004-143470 | | 5/2004 | |
| JP | 2004-143470 | A | 5/2004 | |
| JP | 2004-323925 | A | 11/2004 | |
| JP | 2005-281743 | A | 10/2005 | |
| WO | WO 2004063410 | A1 * | 7/2004 | C22C 38/00 |

OTHER PUBLICATIONS

Machine translation of JP 2004143470.*
European Supplementary Search Report dated Nov. 19, 2009, issued in corresponding European Patent Application No. 05793808.6.
Canadian Office Action dated Nov. 22, 2012, issued in corresponding Canadian application No. 2,624,390.

* cited by examiner

*Primary Examiner* — Rebecca Lee
(74) *Attorney, Agent, or Firm* — Kenyon & Kenyon LLP

(57) ABSTRACT

The invention provides a cold-rolled steel sheet excellent in paint bake hardenability and ordinary-temperature non-aging property comprising, in mass %, C: 0.0005-0.0040%, Si: 0.8% or less, Mn: 2.2% or less, S: 0.0005-0.009%, Cr: 0.4-1.3%, O: 0.003-0.020%, P: 0.045-0.12%, B: 0.0002-0.0010%, Al: 0.008% or less, N: 0.001-0.007%, and a balance of Fe and unavoidable impurities. Ultra-low-carbon steel retaining solute N and containing added Cr, P, B and O is used to produce hot-rolled and cold-rolled steel sheet and hot-dip galvanized cold-rolled steel sheet that exhibit both high paint bake hardenability and ordinary-temperature non-aging property.

9 Claims, No Drawings

COLD-ROLLED STEEL SHEET EXCELLENT IN PAINT BAKE HARDENABILITY AND ORDINARY-TEMPERATURE NON-AGING PROPERTY AND METHOD OF PRODUCING THE SAME

CROSS REFERENCE TO RELATED APPLICATIONS

This application is a national stage application of International Application No. PCT/JP2005/018726, filed Oct. 5, 2005 which is incorporated by reference in its entirety.

FIELD OF THE INVENTION

The present invention relates to a cold-rolled steel sheet exhibiting a combination of paint bake hardenability (BH), ordinary-temperature non-aging property, and formability, and a method of producing the cold-rolled steel sheet.

The cold-rolled steel sheet according to the present invention is usable in vehicles, home electrical appliances, buildings and the like. It includes narrowly defined steel sheet with no surface treatment and broadly defined steel sheet subjected to a surface treatment for corrosion prevention such as hot-dip Zn coating, alloyed hot-dip zinc coating, and electrogalvanizing.

The steel sheet according to the present invention exhibits paint bake hardenability. This enables use of a thinner steel sheet than heretofore, i.e., makes weight reduction possible. The steel sheet can therefore contribute to environmental preservation.

DESCRIPTION OF THE RELATED ART

Thanks to recent advances in vacuum degassing of molten steel, ultra-low-carbon steel can now be readily produced by the melting method. As a result, ultra-low-carbon steel sheet with good workability has come into high demand. Among such steel sheets, ultra-low-carbon steel sheets containing Ti and Nb added in combination as taught by, for example, Japanese Patent Publication (A) No. 59-31827 are steadily assuming a position of importance because of their good workability, along with paint bake hardenability (BH) and excellent hot-dip galvanization property.

However, they have drawbacks in that their BH value does not exceed that of ordinary BH steel sheet and that when an attempt is made to impart additional BH value, ordinary-temperature non-aging property can no longer be achieved.

Japanese Patent Publication (B) No. 3-2224, for example, teaches a steel sheet exhibiting high BH property and ordinary-temperature non-aging property. Specifically, it teaches that a cold-rolled steel sheet exhibiting a combination of high r value, high BH, high ductility and ordinary-temperature non-aging property can be obtained by adding a large amount of Nb and B to ultra-low-carbon steel, further adding Ti, and causing the post-annealing structure to assume a complex structure comprising a ferrite phase and a low-temperature transforming phase.

However, the technique was found to experience the following problems in actual industrial application:

1) In a steel of a composition including such a large amount of Nb and B, together with Ti, the $\alpha \rightarrow \gamma$ transformation point does not decrease, so that very high-temperature annealing is required to obtain the complex structure. Sheet fracture and other problems therefore occur in the course of continuous annealing.

2) Since the $\alpha+\gamma$ temperature zone is very narrow, the structure varies in the sheet width direction. As a result, large material property variation occurs; whether or not the complex structure is established comes to depend on a change in annealing temperature of a few degrees Celsius; and production is very unstable.

Japanese Patent Publication (A) No. 7-300623 teaches that by controlling the post-annealing cooling rate of an ultra-low-carbon cold-rolled steel sheet added with Nb it is possible to increase the carbon concentration at the grain boundaries and thus simultaneously achieve high BH and ordinary-temperature non-aging property. However, the resulting balance between the high BH and the ordinary-temperature non-aging property leaves much to be desired.

Moreover, conventional BH steel sheet has a problem in that while a desired BH value can be obtained by defining the BH heat treatment conditions as 170° C. and 20 min, the BH decreases under conditions of 160° C. and 10 min or 150° C. and 10 min.

SUMMARY OF THE INVENTION

As pointed out in the foregoing, the conventional BH steel sheet is disadvantageous in that it is difficult to produce stably and loses its ordinary-temperature non-aging property at the time the BH value is increased. It also has a problem in that adequate BH value cannot be obtained when the paint bake hardening is conducted not at the temperature of 170° C. currently in general use but at a low temperature in the range of, for instance, 160° C. to 150° C.

The inventors earlier developed a technology for overcoming these problems and filed for patent thereon under Japanese Application No. 2002-251536. Now they have newly discovered that it is possible to improve the balance between paint bake hardenability and ordinary-temperature non-aging property.

The object of the present invention is to provide a cold-rolled steel sheet that exhibits a combination of high BH property and ordinary-temperature non-aging property and that has an adequate BH value even when the BH temperature becomes low, and a method of producing the cold-rolled steel sheet.

The inventors conducted an extensive study for achieving the foregoing object. As a result, they acquired the new knowledge set out in the following.

Specifically, they discovered that by adding Cr and O (oxygen) to a steel in which solute N remains, further adding P and B, and conducting predetermined heat treatment after cold rolling, it is possible to obtain a cold-rolled steel sheet that has better BH and ordinary-temperature non-aging property than heretofore and also exhibits high BH property even in the case of low-temperature, short-period paint bake hardening conditions.

The present invention, which is constituted based on this concept and new knowledge, offers a totally new steel sheet unknown to the prior art. The gist thereof is as follows:

1) A cold-rolled steel sheet excellent in paint bake hardenability and ordinary-temperature non-aging property comprising, in mass %, C: 0.0005-0.0040%,
Si: 0.8% or less,
Mn: 2.2% or less,
S: 0.0005-0.009%,
Cr: 0.4-1.3%,
O: 0.003-0.020%,
P: 0.045-0.12%,
B: 0.0002-0.0010%, Al: 0.008% or less, N: 0.001-0.007%, and a balance of Fe and unavoidable impurities, whose BH170 evaluated by applying heat treatment for 20 min at 170° C. following 2% tensile deformation is 50 MPa or greater and whose BH160 evaluated by applying heat treatment for 10 min at 160° C. following 2% tensile deformation and BH150 evaluated by applying heat treatment for 10 min at 150° C. following 2% tensile deformation are both 45 MPa or greater.

2) A cold-rolled steel sheet excellent in paint bake hardenability and ordinary-temperature non-aging property according to 1), further comprising, in mass %, Mo: 0.001-1.0%.

3) A cold-rolled steel sheet excellent in paint bake hardenability and ordinary-temperature non-aging property according to 1) or 2), further comprising, in mass %, one or more of V, Zr, Ce, Ti, Nb and Mg in a total of 0.001-0.02%.

4) A cold-rolled steel sheet excellent in paint bake hardenability and ordinary-temperature non-aging property according to any of 1) to 3), further comprising, in mass %, solute C: 0.0020% or less and solute N: 0.0005-0.004%.

5) A cold-rolled steel sheet excellent in paint bake hardenability and ordinary-temperature non-aging property according to any of 1) to 4), further comprising, in mass %, Ca: 0.0005-0.01%.

6) A cold-rolled steel sheet excellent in paint bake hardenability and ordinary-temperature non-aging property according to any of 1) to 5), further comprising, in mass %, one or more of Sn, Cu, Ni, Co, Zn and W in a total of 0.001-1.0%.

7) A method of producing a cold-rolled steel sheet excellent in paint bake hardenability and ordinary-temperature non-aging property comprising:

hot rolling a slab having the chemical composition set out in any of 1) to 6) at a temperature of ($Ar_3$ point−100)° C. or greater;

cold rolling the hot-rolled slab at a reduction ratio of 90% or less;

annealing the cold-rolled product to reach a maximum temperature of 750-920° C.; and holding the annealed product for 15 seconds or greater at a temperature in the range of 550-750° C.

8) A method of producing a cold-rolled steel sheet excellent in paint bake hardenability and ordinary-temperature non-aging property comprising:

hot rolling a slab having the chemical composition set out in any of 1) to 6) at a temperature of ($Ar_3$ point−100)° C. or greater;

cold rolling the hot-rolled slab at a reduction ratio of 90% or less;

annealing the cold-rolled product to reach a maximum temperature of 750-920° C.;

holding the annealed product for 15 seconds or greater at a temperature in the range of 550-750° C.; and heat treating the result for 120 seconds or greater at a temperature of 150-450° C.

9) A method of producing a cold-rolled steel sheet excellent in paint bake hardenability and ordinary-temperature non-aging property comprising:

hot rolling a slab having the chemical composition set out in any of 1) to 6) at a temperature of ($Ar_3$ point−100)° C. or greater;

cold rolling the hot-rolled slab at a reduction ratio of 90% or less;

annealing the cold-rolled product on a continuous hot-dip galvanizing line to reach a maximum temperature of 750-920° C.;

holding the annealed product for 15 seconds or greater at a temperature in the range of 550-750° C.; and immersing the product in a galvanizing bath.

10) A method of producing a cold-rolled steel sheet excellent in paint bake hardenability and ordinary-temperature non-aging property according to 9), further comprising:

heat treating the product for 1 second or greater at a temperature of 460-550° C. after immersing it in the galvanizing bath.

The present invention makes it possible to obtain a steel sheet having a good balance between high BH property and ordinary-temperature non-aging property.

DETAILED DESCRIPTION OF THE INVENTION

The reasons for limiting the steel composition and production conditions in the present invention as set out in the foregoing will now be explained in further detail. Unless otherwise indicated, % indicates mass %.

C beneficially improves BH property. However, with currently available steelmaking technologies, it is difficult and costly to achieve a C content of less than 0.0005%, so this value is set as the lower limit. On the other hand, a C content exceeding 0.0040% not only degrades formability but also makes it difficult to achieve both high BH property and ordinary-temperature non-aging property, which are important attributes of the present invention steel sheet, so this value is defined as the upper limit. The still more preferable C content range is 0.0007% to less than 0.025%.

Si functions as a solid solution hardening element that is cheap and capable of increasing strength without excessively degrading formability. Although the amount added is varied in accordance with the targeted strength level, the upper limit of addition is defined as 0.8% because higher contents than this cause surface property problems. When hot-dip galvanizing or alloyed hot-dip zinc coating is applied, the Si content is preferably made 0.6% or less to avoid problems such as degradation of coating adherence and decline in productivity owing to delayed alloying reaction. The upper limit is preferably set at 0.05% for applications like the outer panels of car doors and hoods where surface quality is particularly important.

Si content is not assigned any particular lower limit but reducing the content to 0.001% or less makes production cost high, so this value is the lower limit practically speaking. When Al deoxidation is hard to conduct owing to Al content control considerations, Si deoxidation is possible. In such a case, Si content is made 0.04% or greater.

Mn is useful as a solid solution hardening element. Moreover, by forming MnS it works to inhibit edge cracking. As Mn also exhibits an effect of inhibiting ordinary-temperature aging caused by solute N, it is preferably incorporated at 0.3% or greater. However, when deep drawability is required, the Mn content is preferably 0.15% or less, more preferably less than 0.10%. A content in excess of 2.2% increases strength too much, thus lowering ductility, and also impairs zinc coating adherence. The upper limit of Mn content is therefore defined as 2.2%.

S content is assigned an upper limit of 0.009% because in excess of this level, S causes hot cracking and degrades workability. On the other hand, achieving an S content of less than 0.0005% is difficult with currently available steelmaking technologies, so this value is defined as the lower limit.

Cr is an important element in the present invention. Addition of Cr to a content of 0.4% or greater enables simultaneous achievement of high BH property and ordinary-temperature aging resistance property. It is known that ordinary-temperature aging resistance property is hard to achieve because N has a faster dispersion velocity than C. BH steel sheet utilizing N is therefore not used for car outer panels and other components whose appearance is a major concern.

However, it was discovered that positive addition of Cr makes it possible to obtain ordinary-temperature non-aging property without impairing BH property. The mechanism by which these elements improve ordinary-temperature aging resistance property is not altogether clear, but it is surmised to be as follows.

At near ordinary-temperature, these elements and N form pairs or clusters that restrain N dispersion and thus establish ordinary-temperature aging resistance property. In contrast, when paint bake hardening is conducted at a temperature of 150-170° C., N breaks out of the pairs and clusters to immobilize dislocations, whereby high BH property is manifested.

When Cr is present in excess, Cr nitrides precipitate, possibly causing loss of BH property. Excessive addition of Cr is also undesirable from the viewpoint of workability, coating adherence, and cost. The upper limit of Cr content is therefore defined as 1.3%. The content range is more preferably 0.5-0.8%.

O (oxygen) is also an especially important element in the present invention. It was discovered that controlling O to a predefined content amplifies the aforesaid contribution of Cr to BH and ordinary-temperature non-aging property. The reason is not altogether clear but it is surmised to be because Cr and N preferentially segregate around oxides, thereby augmenting the aforesaid N dispersion suppressing effect of Cr at ordinary-temperature.

This effect becomes prominent at an O content of 0.003% or greater, so this value is defined as the lower limit of O content. When O content exceeds 0.020%, the effect tends to saturate and, in addition, r value, ductility and other workability properties deteriorate. The upper limit of O content is therefore set at 0.020%. The more preferable range of O content is 0.005-0.015%. O is ordinarily present in the form of Fe oxides but it may instead be present in the form of oxides or complex oxides of Al, Ce, Zr, Mg, Si and the like. But Al-based oxides should be minimized to the utmost possible because they contribute little to simultaneous achievement of high BH and ordinary-temperature non-aging property and degrade surface properties.

The form, size and distribution of the oxides are not particularly limited, but spherical oxides are desirable from the viewpoint of maximizing surface area. The spherical oxides preferably have an average diameter of 1.0 μm or less, and the ratio thereof present at the grain boundaries of the product sheet is preferably 20% or less by volume. The desirability of satisfying these conditions is based on the benefit obtainable by increasing effective sites for Cr and N segregation to the utmost possible. By the same token, it is effective to finely disperse not only oxides but also MnS, CaS, CuS and the like.

P is an important element in the present invention. This is because it was newly found that P addition works to further improve the balance between the aforesaid paint bake hardenability and ordinary-temperature non-aging property resulting from the addition of Cr and O. This effect of P is manifested only upon addition in combination with B, as explained below.

It is not clear why P exhibits this effect, but it is surmised that the segregation of P at the grain boundaries prevents N, which is effective for imparting BH property, from segregating at the grain boundaries, thereby augmenting the aforesaid action of Cr and O with respect to N.

This effect of P is manifested at a P content of 0.045% or greater. But at an amount of addition exceeding 0.12%, not only does the effect saturate but fatigue strength after spot welding deteriorates, while yield strength increases excessively to give rise to substandard surface shape during pressing. In addition, the alloying reaction during continuous hot-dip galvanizing becomes extremely slow, causing a decline in productivity. Secondary workability also deteriorates. The upper limit of P addition is therefore defined as 0.12%. The preferable range is 0.05-0.085%.

B is also important. B also works to improve the balance between paint bake hardenability and ordinary-temperature non-aging property. The improvement mechanism is thought to be the same as that by P explained earlier. B must be added simultaneously with P. For this effect of B to be manifested, the element needs to be added to a content of 0.0002% or greater. When B is added in excess of 0.0010%, the effect saturates and BH property deteriorates owing to formation of B nitrides. The upper limit of B content is therefore defined as 0.0010%. The preferable content range is 0.0004-0.0008%.

Al can be used as a deoxidation regulator. However, addition of Al lowers BH property because the Al combines with N to form AlN. The amount added should be held to the minimum required, within the range that does not interfere with production from the technology aspect. From this viewpoint, the upper limit is defined as 0.008% or less in the case of a cold-rolled steel sheet. At an Al content exceeding 0.008%, the total amount of N added must be great in order to obtain solute N, which is disadvantageous from the points of production cost and formability. The Al content is more preferably less than 0.005% and still more preferably less than 0.003%.

N is an important element in the present invention. Namely, the present invention achieves high BH property mainly by utilizing N. N must therefore be added to a content of 0.001% or greater. But when the N content is excessive, an undue amount of Cr must be added to obtain ordinary-temperature non-aging property, while workability is degraded. The upper limit of N addition is therefore set at 0.007%. The preferable range is 0.0015-0.0035%.

N readily combines with Al to form AlN. It is therefore desirable to ensure the presence of N for contributing to BH by satisfying the relationship $N-0.52\ Al>0\%$ and preferably by satisfying the relationship $N-0.52\ Al>0.0005\%$. These expressions were determined in light of it being a condition that, stoichiometrically, the amount N is required to be greater than the amount of Al.

Mo can be incorporated at a content of 0.001% or greater to serve chiefly as a solid solution hardening element. Although addition of a large amount of Mo can be expected to offer hardening by carbonitride formation, heavy addition markedly degrades ductility. The upper limit of Mo content is therefore defined as 1.0%.

V is effective for establishing ordinary-temperature non-aging property when added in the presence of Cr. It is therefore preferably added to a content of 0.001% or greater. On the other hand, formation of nitrides is promoted when V is added together with one or more of Zr, Ce, Ti, Nb and Mg discussed below in such amount that the total content of the elements becomes greater than 0.02%. The upper limit of V addition is therefore defined as 0.02%.

Zr, Ce, Ti, Nb and Mg are effective deoxidization elements. Moreover, they do not readily float in the molten steel and therefore tend to remain in the steel as oxides that serve as Cr and N segregation sites. In addition, Nb and Ti are well known for their ability to improve workability. When added independently, each is added to a content of 0.001% or greater and preferably to a content of 0.003% or greater. However, excessive addition causes nitride formation that diminishes the amount of solute N available. Therefore, when one or more of these elements is added, the total amount of addition plus the amount of added V is similarly made 0.02% or less.

Solute C content is preferably 0.0020% or less. The present invention chiefly utilizes N to establish high BH property and ordinary-temperature non-aging property. Ordinary-temperature non-aging property is therefore difficult to achieve when the solute C content is too high. Solute C content is preferably less than 0.0015% and most preferably 0%. Regulation of solute C content can be conducted either by keeping total C content at or below the aforesaid upper limit or by reducing solute C content to a predetermined level by controlling the coiling temperature and/or averaging conditions.

The solute N content is preferably made 0.0005-0.004% in total. This solute N is defined to include not only N independently present in the Fe but also N that forms pairs and clusters with substitutional solid solution elements such as Cr, Mo, V, Mn, Si, and P. Solute N content can be calculated from the value obtained by substracting from the total N content that N present in compounds such as AlN, NbN, VN, TiN, BN and ZrN (determined from results of chemical analysis of the extraction residue). It can also be determined by the internal friction method or by field ion microscopy (FIM). When the amount of solute N is below 0.0005%, sufficient BH cannot be obtained. When it exceeds 0.004%, BH improves but ordinary-temperature non-aging property is difficult to achieve. A more preferable range of solute N content is 0.0008-0.0022%. Preferably, 50% or more of the solute N should form pairs with Cr or segregate around oxides or precipitates. The location of such N can be ascertained by FIM.

Ca is effective for deoxidizing and also for controlling the shape of sulfides. It can therefore be added to a content in the range of 0.0005-0.01%. At a content below 0.0005%, sufficient effect is not obtained, while addition in excess of 0.01% degrades workability. The range of the Ca addition is therefore defined as 0.0005-0.01%.

A total of 0.001 to 1% of one or more of Sn, Cu, Ni, Co, Zn and W can be added to a steel containing the above elements as main components for the purpose of increasing mechanical strength and/or improving fatigue properties. Moreover, REMs other than Ce can be incorporated to a total content of 0.1% or less Next, the reasons for limiting the production conditions will be explained.

The slab to be hot-rolled is not particularly restricted. Specifically, it can be a continuously cast slab or a slab produced using a thin slab caster or the like. A slab produced by a process such as the continuous casting-direct rolling (CC-DR) process in which the slab is hot-rolled immediately after casting is also suitable for the present invention.

The hot rolling finish temperature is ($Ar_3$ point−100)° C. or greater. If the finish temperature is below ($Ar_3$ point−100)° C., it is difficult to achieve good workability or sheet thickness accuracy. A temperature in a range above the $Ar_3$ point is more preferable. The effects of the present invention can be realized without setting any particular upper limit for the hot rolling finish temperature, but it is desirable for the temperature to be 1000° C. or less in order to achieve a desirable r value.

The heating temperature of the hot rolling is not specifically restricted. However, when melting is necessary to obtain a sufficient amount of solute N, it is desirable to heat the slab to 1150° C. or greater.

The post-hot-rolling coiling temperature is preferably 750° C. or less. Although no particular lower limit is defined, a temperature of 200° C. or greater is preferable for achieving good workability.

The cold rolling reduction ratio is 90% or less. Use of a reduction ratio exceeding 90% places a heavy burden on the production equipment and also results in a product with large anisotropy in mechanical properties. The reduction ratio is preferably 86% or less. Although a lower limit is not particularly defined for the reduction ratio, a reduction ratio of 30% or greater is preferable for achieving good workability.

The maximum temperature reached in annealing falls in the range of 750-920° C. When the annealing temperature is below 750° C., recrystallization is incomplete and workability deteriorates. When the annealing temperature exceeds 920° C., the structure becomes coarse and workability is degraded. A more preferable range of the annealing temperature is 770-870° C.

The post-annealing cooling is important in the present invention. Specifically, post-annealing holding for 15 seconds or greater in the temperature range of 550-750° C. is required. The holding need not be at a constant temperature. It suffices for the time spent in the temperature range of 550-750° C. to be 15 seconds or greater and aside from this requirement the thermal history is of no concern. This heat treatment enables production of a steel sheet that exhibits high BH property and is excellent in ordinary-temperature non-aging property. The heat treatment is more preferably conducted in the temperature range of 600-700° C. for 20 seconds or greater.

Overaging treatment conducted following heat treatment is effective for further improving paint bake hardenability and ordinary-temperature non-aging property. An overaging temperature of 150-450° C. suffices and the duration of the treatment should be 120 seconds or greater. Although no upper limit is particularly defined for the duration of the averaging treatment, the treatment is preferably conducted for not more than 1000 seconds because prolonged treatment lowers productivity.

When a hot dip galvanizing is to be applied, annealing is conducted to reach a maximum temperature in the range of 750-920° C., followed by holding for 15 seconds or greater in the temperature range of 550-750° C. The holding need not be at a constant temperature. It suffices for the time spent in the temperature range of 550-750° C. to be 15 seconds or greater and aside from this requirement the thermal history is of no concern. This heat treatment enables production of a steel sheet that exhibits high BH property and is excellent in ordinary-temperature non-aging property. The heat treatment is more preferably conducted in the temperature range of 600-700° C. for 20 seconds or greater.

The steel sheet is then immersed in a galvanizing bath. The temperature of the galvanizing bath is 420-500° C. When the zinc on the surface and the iron of the steel sheet are to be alloyed, the immersion in the galvanizing bath is followed by heat treatment at a temperature of 460-550° C. for 1 second or greater and preferably 5 seconds or greater. No upper limit is particularly set for the duration of the alloying heat treatment, but it is preferable from the productivity viewpoint to limit the time to 40 seconds or less.

Although it is not altogether clear why the aforesaid conditions are optimal for improving ordinary-temperature non-aging property, the reason is thought to be that the conditions facilitate segregation of P and B at the grain boundaries and promote segregation of Cr and N around oxides.

Temper rolling further improves ordinary-temperature non-aging property. For shape correction, it should be conducted at a reduction ratio of 3% or less. The upper limit of the reduction ratio is defined as 3% because above this level yield strength increases to put a heavy burden on the production equipment.

The structure of the cold-rolled steel sheet according to the present invention contains ferrite or bainite as the main phase, but it is acceptable for the two phases to be present as a mixture. It is also acceptable for martensite, oxides, carbides and nitrides to be present in the mixture. This enables different structures to be formed in accordance with the required characteristics.

BH170 of the steel sheet produced according to the present invention is 50 MPa or greater, and its BH160 and BH150 are both 45 MPa or greater. No upper limits are particularly defined for the BHs, but when BH170 exceeds 150 MPa or either BH160 or BH150 exceeds 130 MPa, it becomes difficult to achieve ordinary-temperature aging resistance property. BH170 represents BH evaluated by applying 2% tensile deformation followed by heat treatment at 170° C. for 20 min, BH160 represents BH evaluated by applying 2% tensile deformation followed by heat treatment at 160° C. for 10 min, and BH150 represents BH evaluated by applying 2% tensile deformation followed by heat treatment at 150° C. for 10 min.

The ordinary-temperature non-aging property is evaluated based on the yield point elongation after an artificial aging treatment. The yield point elongation of the steel sheet produced according to the present invention determined in a tensile test after a heat treatment at 100° C. for 1 hour is 0.3% or less and preferably 0.2% or less.

The present invention will be explained hereafter based on examples.

EXAMPLES

Example 1

Steels having the chemical compositions shown in Table 1 were hot-rolled at a slab heating temperature 1220° C., finish temperature of 940° C., and coiling temperature of 600° C., to obtain 3.5-mm thick steel strips. Each strip was pickled and cold rolled at a reduction ratio of 80% to produce a 0.7-mm thick cold-rolled sheet. The cold-rolled sheet was annealed in a continuous annealer under conditions of a heating rate of 10° C./second and maximum attained temperature of 800° C. Then, the annealed sheet was cooled in the temperature range of 550-750° C. As shown in Table 2, the holding time in this temperature range was varied among the different sheets. The overaging treatment temperature was also varied. The overaging treatment time was fixed at 180 seconds. After applying temper rolling at a reduction ratio of 1.0%, JIS No. 5 tensile test pieces were cut from the sheets. The test pieces were measured for BH and, after artificial aging, for yield point elongation.

The results are shown in Table 2. As is clear from the results, when the steels of the chemical composition of the present invention were annealed under suitable conditions, the products were advantageous in terms of balance between high BH property and ordinary-temperature non-aging property.

Example 2

Steels B and G among the steels listed in Table 1 were hot-rolled at a slab heating temperature 1180° C., finish temperature of 910° C., and coiling temperature of 650° C., to obtain 4.0-mm thick steel strips. Each strip was pickled and cold rolled at a reduction ratio of 80% to produce a 0.8-mm thick cold-rolled sheet. The cold-rolled sheet was annealed in a continuous hot-dip galvanizer under conditions of a heating rate of 14° C./second and maximum attained temperature of 820° C. The annealed sheet was then cooled in the temperature range of 550-750° C. The holding time in this temperature range was changed between the two sheets. The sheet was immersed in a 460° C. galvanizing bath, reheated to 500° C. at 15° C./second, and held for 15 seconds. Then, after applying temper rolling at a reduction ratio of 0.8%, JIS No. 5 tensile test pieces were cut from the sheets. The test pieces were measured for BH and, after artificial aging, for yield point elongation.

The results are shown in Table 3. As is clear from the results, when the production was carried out under appropriate conditions, high BH property and ordinary-temperature non-aging property were simultaneously achieved.

TABLE 1

| Steel | C | Si | Mn | P | S | Al | Cr | O | N | B | Other | Remark |
|---|---|---|---|---|---|---|---|---|---|---|---|---|
| A | 0.0013 | 0.01 | 0.12 | 0.006 | 0.006 | 0.003 | 0.55 | 0.0020 | 0.0023 | — | Ce = 0.003% | Comparative |
| B | 0.0011 | 0.01 | 0.09 | 0.006 | 0.004 | 0.003 | 0.57 | 0.0064 | 0.0019 | 0.0005 | — | Comparative |
| C | 0.0014 | 0.01 | 0.10 | 0.035 | 0.005 | 0.002 | 0.69 | 0.0087 | 0.0025 | — | — | Comparative |
| D | 0.0015 | 0.02 | 0.11 | 0.058 | 0.004 | 0.002 | 0.66 | 0.0083 | 0.0025 | — | — | Comparative |
| E | 0.0014 | 0.01 | 0.10 | 0.061 | 0.005 | 0.001 | 0.70 | 0.0080 | 0.0026 | 0.0005 | — | Invention |
| F | 0.0017 | 0.01 | 0.10 | 0.060 | 0.005 | 0.001 | 1.02 | 0.0069 | 0.0030 | 0.0006 | Nb = 0.003% | Invention |
| G | 0.0013 | 0.01 | 0.13 | 0.085 | 0.003 | 0.002 | 0.65 | 0.0051 | 0.0022 | 0.0004 | Mo = 0.03% | Invention |
| H | 0.0012 | 0.02 | 0.55 | 0.052 | 0.004 | 0.002 | 0.74 | 0.0072 | 0.0029 | 0.0006 | Nb = 0.005% | Invention |
| I | 0.0013 | 0.01 | 1.58 | 0.076 | 0.002 | 0.001 | 0.85 | 0.0057 | 0.0033 | 0.0007 | Nb = 0.009% | Invention |

Underlining indicates values outside invention range.

TABLE 2

| | Hold time at 550-750° C. (s) | Overaging temp (° C.) | TS (MPa) | YS (MPa) | Average r value | El (%) | BH170 (MPa) | BH160 (MPa) | BH150 (MPa) | Yield point elongation after 100° C., 1 hr heat treatment (%) | Within scope of invention? |
|---|---|---|---|---|---|---|---|---|---|---|---|
| A | 22 | 400 | 288 | 158 | 1.6 | 51 | 75 | 73 | 71 | 0.23 | No |
| B | 20 | 350 | 305 | 167 | 1.7 | 50 | 68 | 65 | 64 | 0.09 | No |
| C | 3 | 300 | 329 | 181 | 1.7 | 48 | 75 | 75 | 73 | 0.14 | No |
| C | 3 | None | 334 | 195 | 1.6 | 47 | 80 | 77 | 73 | 0.19 | No |
| D | 20 | 350 | 356 | 213 | 1.6 | 45 | 82 | 76 | 78 | 0.22 | No |
| D | 20 | None | 360 | 218 | 1.6 | 44 | 85 | 85 | 83 | 0.32 | No |
| E | 3 | 350 | 372 | 222 | 1.6 | 44 | 81 | 80 | 80 | 0.22 | No |
| E | 20 | 350 | 374 | 219 | 1.6 | 43 | 95 | 90 | 88 | 0.04 | Yes |
| E | 20 | None | 375 | 220 | 1.6 | 43 | 97 | 96 | 90 | 0.05 | Yes |
| F | 30 | 330 | 381 | 234 | 1.7 | 42 | 102 | 93 | 95 | 0.08 | Yes |
| F | 5 | 330 | 382 | 226 | 1.7 | 42 | 86 | 87 | 82 | 0.24 | No |
| G | 20 | 350 | 398 | 242 | 1.6 | 41 | 83 | 82 | 82 | 0.01 | Yes |
| G | 30 | 400 | 400 | 241 | 1.6 | 40 | 87 | 85 | 84 | 0.00 | Yes |
| H | 20 | 250 | 391 | 235 | 1.8 | 42 | 90 | 91 | 90 | 0.02 | Yes |
| H | 4 | 250 | 388 | 232 | 1.7 | 42 | 72 | 70 | 66 | 0.18 | No |
| I | 35 | 380 | 443 | 267 | 1.7 | 37 | 88 | 87 | 86 | 0.00 | Yes |
| I | 5 | 380 | 440 | 270 | 1.7 | 36 | 66 | 65 | 63 | 0.15 | No |

Underlining indicates values outside invention range.

TABLE 3

| | Hold time at 550-750° C. (s) | TS (MPa) | YS (MPa) | Average r value | El (%) | BH170 (MPa) | BH160 (MPa) | BH150 (MPa) | Yield point elongation after 100° C., 1 hr heat treatment (%) | Within scope of invention? |
|---|---|---|---|---|---|---|---|---|---|---|
| E | 20 | 370 | 215 | 1.7 | 45 | 97 | 96 | 94 | 0.04 | Yes |
| E | 50 | 368 | 210 | 1.7 | 46 | 101 | 98 | 95 | 0.02 | Yes |
| E | 10 | 374 | 221 | 1.6 | 44 | 83 | 80 | 78 | 0.22 | No |
| H | 20 | 386 | 229 | 1.8 | 42 | 92 | 93 | 90 | 0.03 | Yes |
| H | 50 | 382 | 227 | 1.9 | 43 | 98 | 95 | 92 | 0.02 | Yes |
| H | 10 | 380 | 225 | 1.7 | 43 | 70 | 73 | 69 | 0.16 | No |

Underlining indicates values outside invention range.

What is claimed is:

1. A method of producing a cold-rolled steel sheet excellent in paint bake hardenability and ordinary-temperature non-aging property comprising:

a slab consisting of in mass %,

C: 0.0005-0.0040%,

Si: 0.8% or less,

Mn: 2.2% or less,

S: 0.0005-0.009%,

Cr: 0.4-1.3%,

O: 0.003-0.020%,

P: 0.045-0.12%,

B: 0.0002-0.0010%,

Al: 0.008% or less,

N: 0.001-0.007%, optionally at least one of V, Zr, Ce, Ti, Nb, Mg: 0.001-0.02% in total, and a balance of Fe and unavoidable impurities;

hot rolling the slab at a temperature of ($Ar_3$ point −100)° C. or greater;

cold rolling the hot-rolled slab at a reduction ratio of 90% or less;

annealing the cold-rolled product to reach a maximum temperature of 750-920° C.; and during a post-annealing cooling process, holding the annealed product for 20 to 50 seconds at a temperature range of 550-750° C., wherein the steel satisfies the relationship N−0.52 Al>0%, 50% or more of solute N form pairs with Cr or segregate around oxides or precipitates, and the steel sheet has a yield point elongation equal to or less than 0.08% and a bake hardenability of at least 82 MPa, wherein the cold-rolled steel sheet comprises a structure that consists of ferrite and/or bainite as the main phase, and optionally contains martensite.

2. A method of producing a cold-rolled steel sheet excellent in paint bake hardenability and ordinary-temperature non-aging property comprising:

a slab consisting of in mass %,

C: 0.0005-0.0040%,

Si: 0.8% or less,

Mn: 2.2% or less,

S: 0.0005-0.009%,

Cr: 0.4-1.3%,

O: 0.003-0.020%,

P: 0.045-0.12%,

B: 0.0002-0.0010%,

Al: 0.008% or less,

N: 0.001-0.007%, optionally at least one of V, Zr, Ce, Ti, Nb, Mg: 0.001-0.02% in total, and a balance of Fe and unavoidable impurities;

hot rolling the slab at a temperature of ($Ar_3$ point−100)° C. or greater;

cold rolling the hot-rolled slab at a reduction ratio of 90% or less;

annealing the cold-rolled product on a continuous hot-dip galvanizing line to reach a maximum temperature of 750-920° C.;

during a post-annealing cooling process, holding the annealed product for 20 to 50 seconds at a temperature range of 550-750° C.; and immersing the product in a galvanizing bath, wherein the steel satisfies the relationship N−0.52 Al>0%, 50% or more of solute N form pairs with Cr or segregate around oxides or precipitates, and the steel sheet has a yield point elongation equal to or less than 0.08% and a bake hardenability of at least 82 MPa, wherein the cold-rolled steel sheet comprises a structure that consists of ferrite and/or bainite as the main phase, and optionally contains martensite.

3. A method of producing a cold-rolled steel sheet excellent in paint bake hardenability and ordinary-temperature non-aging property according to claim 2, further comprising:

heat treating the product for 1 second or greater at a temperature of 460-550° C. after immersing it in the galvanizing bath.

4. A method of producing a cold-rolled steel sheet excellent in paint bake hardenability and ordinary-temperature non-aging property according to claim 1, wherein said holding the annealed product at a temperature range of 550-750° C. in a post-annealing cooling process is for 30 seconds or greater.

5. A method of producing a cold-rolled steel sheet excellent in paint bake hardenability and ordinary-temperature non-aging property according to claim 2, wherein said holding the annealed product at a temperature range of 550-750° C. in a post-annealing cooling process is for 30 seconds or greater.

6. A method of producing a cold-rolled steel sheet excellent in paint bake hardenability and ordinary-temperature non-aging property according to claim 1, wherein during the post-annealing cooling process, said annealed product is held for 20 seconds or greater at a temperature range of 600-700° C.

7. A method of producing a cold-rolled steel sheet excellent in paint bake hardenability and ordinary-temperature non-aging property according to claim 2, wherein during the post-annealing cooling process, said annealed product is held for 20 seconds or greater at a temperature range of 600-700° C.

8. A method of producing a cold-rolled steel sheet excellent in paint bake hardenability and ordinary-temperature non-aging property according to claim 1, wherein the steel sheet has a bake hardenability of at least 87 MPa and the main phase is ferrite.

9. A method of producing a cold-rolled steel sheet excellent in paint bake hardenability and ordinary-temperature non-aging property according to claim 2, wherein the steel sheet has a bake hardenability of at least 87 MPa and the main phase is ferrite.

* * * * *